United States Patent [19]

Maerfeld et al.

[11] Patent Number: 4,547,870

[45] Date of Patent: Oct. 15, 1985

[54] VELOCITY HYDROPHONE

[75] Inventors: Charles Maerfeld, Antibes; Michel Josserand, Villeneuve-Loubet; Claude Gragnolati, Cannes, all of France

[73] Assignee: Thomson-CSF, Paris, France

[21] Appl. No.: 573,454

[22] Filed: Jan. 24, 1984

[30] Foreign Application Priority Data

Jan. 28, 1983 [FR] France ..... 83 01336

[51] Int. Cl.[4] ..... H04R 17/00

[52] U.S. Cl. ..... 367/155; 367/161

[58] Field of Search ..... 367/153, 155, 157, 158, 367/160, 161, 163; 310/329, 330, 331

[56] References Cited

U.S. PATENT DOCUMENTS

| | | | |
|---|---|---|---|
| 2,842,685 | 7/1958 | Petermann et al. | 367/160 X |
| 3,079,584 | 2/1963 | Sims . | |
| 3,104,334 | 9/1963 | Bradley, Jr. et al. | 310/329 |
| 3,603,921 | 9/1971 | Dreisbach | 367/155 |
| 3,706,967 | 12/1972 | Renna . | |
| 3,801,839 | 4/1974 | Yo | 310/329 X |
| 4,268,912 | 5/1981 | Congdon . | |

FOREIGN PATENT DOCUMENTS

| | | |
|---|---|---|
| 2346649 | 3/1975 | Fed. Rep. of Germany . |
| 2209267 | 6/1974 | France . |
| 2263656 | 10/1975 | France . |
| 2327677 | 5/1977 | France . |

OTHER PUBLICATIONS

*Navy Tech. Discl. Bull.*, vol. 3, No. 4, Apr. 1978, pp. 45–50, A. Tims: "A Piezoelectric Standard Reference Hydrophone".

*Primary Examiner*—Harold J. Tudor

*Attorney, Agent, or Firm*—Pollock, VandeSande & Priddy

[57] ABSTRACT

A directional velocity hydrophone is provided which does not appreciably disturb the particular movement of the fluid in which it is plunged and which comprises bending blades disposed in a ring and embedded in an inertial mass, which deliver an electric current substantially proportional to the particular speed of the fluid.

3 Claims, 18 Drawing Figures

VELOCITY HYDROPHONE

BACKGROUND OF THE INVENTION

1. Field of the Invention

The invention relates to hydrophones and in particular to devices of this type which deliver an electric signal in response to the vibratory velocity of the incident acoustic waves, this response being flat over an extended frequency range.

2. Description of the Prior Art

To construct a velocity hydrophone, it is known to use acoustic pressure transducers adapted so as to supply an electric signal characteristic of the pressure gradient within the acoustic wave. Pressure gradient hydrophones are then formed by a pair of cells sensing the pressure at two distinct locations. However, because of the fixed spacing between the cells, the sensitivity varies as a function of the frequency. The velocity hydrophone to which the present invention applies comprises a mobile element plunged in fluid, so as to take on the particular movement generated by the acoustic wave at a given location. Reference is thus made to the alternate bending deformation undergone by the mobile element embedded by its end in a reference mass for developing an electric current by piezoelectric effect. This current forms advantageously the response signal independent of the frequency in a range situated above the natural resonance frequency of the deformable assembly comprising the reference mass.

Thus, in this velocity hydrophone, the electric acoustic transducer element has a lamellar or blade like shape with sufficient flexibility to deliver an electric signal substantially proportional to the particular velocity of the fluid at the level of the wave front received by the hydrophone. In the immediate vicinity of the transducer element, the particular movement of the fluid is complex particularly because the transducer element vibrates under flexion, with a range of movement related to the distance which separates it from the inertial mass in which the transducer element is embedded.

To obtain a response sensitive to the flexion, the transducer element comprises several suitably biased layers.

So that the electric signal delivered is representative of the particular velocity over an extended frequency range, it is necessary to connect the output electrodes of the active piezoelectric element to a user circuit having a low electric impedance with respect to the capacitive reactances of the transducer element.

To improve the response at low frequencies of a speed hydrophone, its resonance frequency should be reduced, contrary to what happens with the pressure hydrophones, where efforts are made rather to extend the response towards the high frequencies by adopting a more rigid structure or a structure with reduced mass.

In the case of the hydrophone of the invention, a choice may be made between materials with low piezoelectric coefficients and low modulus of elasticity such as piezoelectric polymers or materials with high piezoelectric coefficients and high modulus of elasticity such as piezoelectric ceramics. The stiffness and sensitivity depend on the choice of the thickness of the materials used, but the extent and the particular shape of the deformable element are also important, for they condition the extent of the frequency range where a flat response may be reckoned on.

SUMMARY OF THE INVENTION

The invention has principally as its object a velocity hydrophone with mobile assembly comprising at least one piezoelectric transducer element with lamellar shape connected by being embedded to an inertial mass, said transducer element sensing the particular speed of the fluid in which it is plunged, wherein said element is formed of flexible blades separated radially and mounted in a ring; each of said blades having one end embedded in said inertial mass.

BRIEF DESCRIPTION OF THE DRAWINGS

The invention will be better understood from the following description and accompanying Figures, given by way of non limiting examples, in which.

DESCRIPTION OF THE PREFERRED EMBODIMENT

Figure 1:
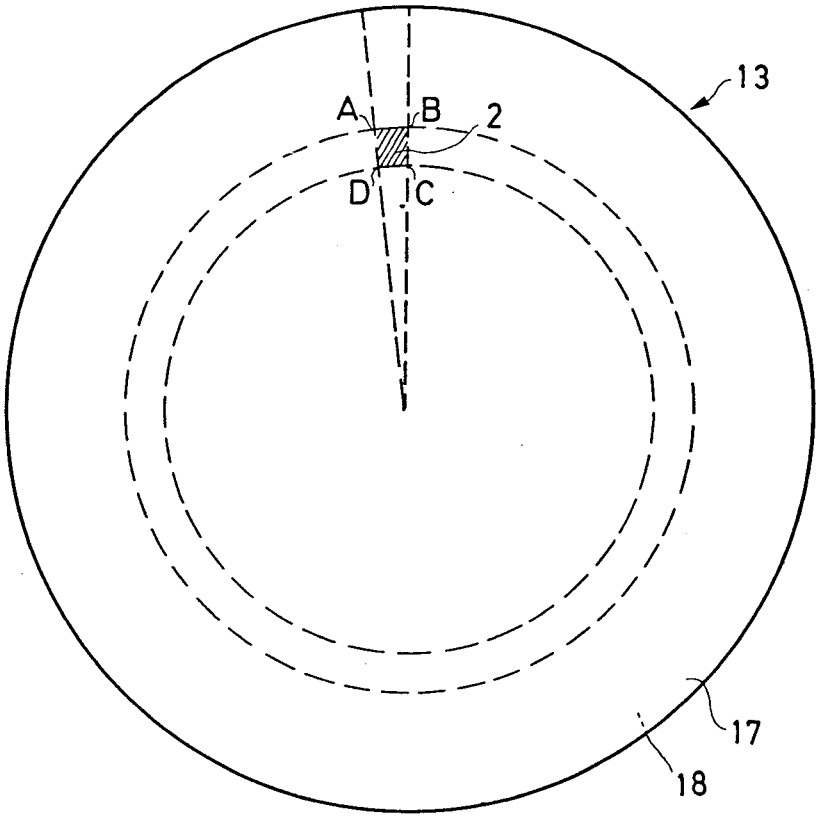
FIG. 1 is an explanatory Figure.

In FIG. 1 is shown a piezoelectric transducer element in the form of a disk 13. This transducer element is made for example from polyvinyl fluoride ($PVF_2$). Its main faces comprise electrodes 17 and 18 for collecting the electric charges induced by piezoelectric effect when it operates as a sensor of acoustic vibrations propagated by the aqueous medium in which it is immersed.

Figure 2:
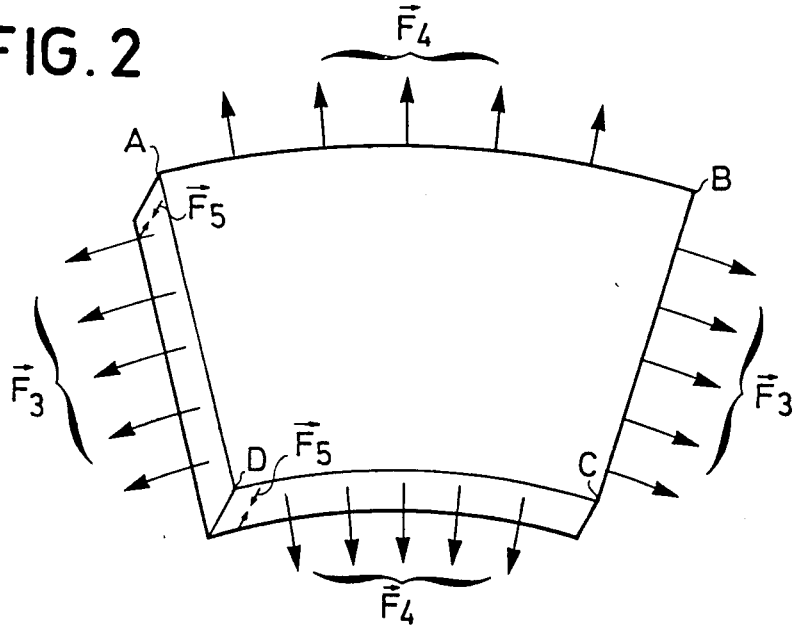
FIG. 2 shows the zone 2 of FIG. 1.

FIG. 2 shows the zone 2 of the transducer element 13 of FIG. 1 defined by the points A, B, C and D. During the flexion produced by an incident acoustic wave, different mechanical stresses govern the equilibrium of zone 2. $F_4$ shows the radial stresses. $F_5$ shows the tangential stresses along the normals to the main faces of element 2. $F_3$ shows the circumferential stresses. The invention proposes suppressing these circumferential stresses which add stiffness to disk 13, by forming radial cut-outs which break the disk down into flexible blades disposed in a ring.

Figure 3:
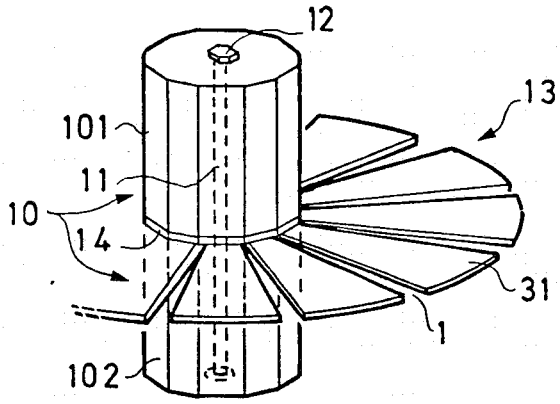
FIG. 3 shows a perspective view of a hydrophone in accordance with the invention.

FIG. 3 is an elevational view of a hydrophone in accordance with the invention. This hydrophone comprises a piezoelectric transducer element 13 formed of identical flexible blades 31 disposed around a mass 10 forming an embedding housing. The cut-outs 1 form spaces between the blades 31 forming a transducer element 13. Mass 10 is formed of two blocks 101 and 102 between which the blades 31 are nipped. Blocks 101 and 102 are formed from a high density material, for example tungsten. Blocks 101 and 102 are pierced axially with a bore, so as to be clamped against elements 31 by means of a bolt 11 and nut 12.

Figure 4:
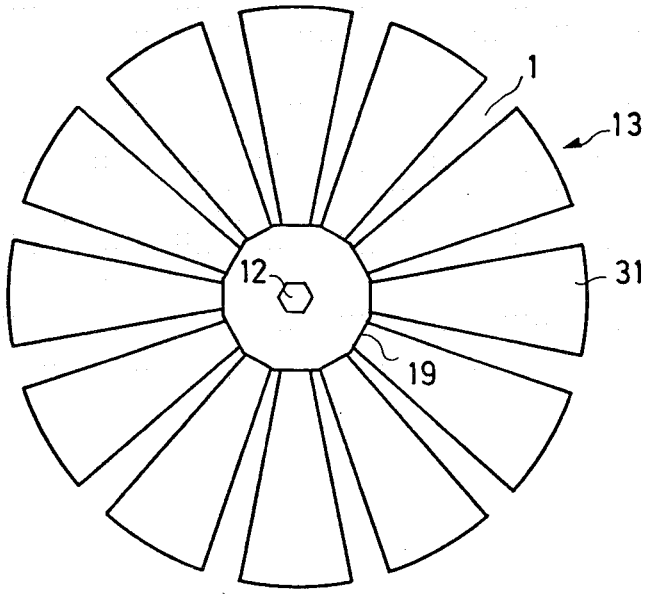
FIG. 4 shows a top view of the hydrophone of FIG. 3.
Figure 5:
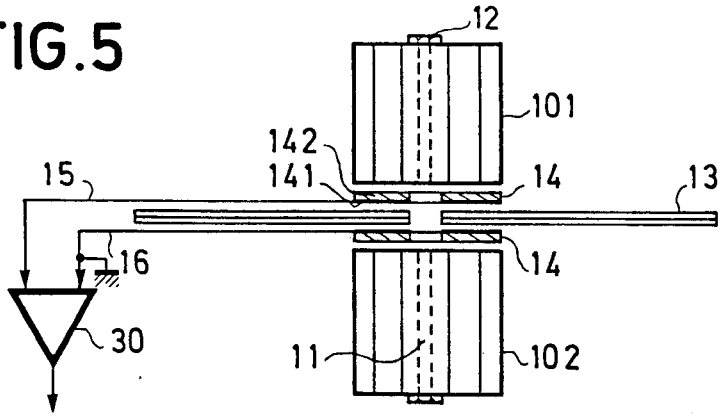
FIG. 5 is an elevational view of the hydrophone of FIG. 3 connected to a differential amplifier.

In FIGS. 3 to 5, it can be seen that blocks 101 and 102 are machined with as many facets 19 as there are blades. Advantageously, each blade 31 has an outwardly tapering shape towards the periphery as shown in FIGS. 3 and 4.

FIG. 5 is an elevational view of the hydrophone of FIGS. 3 and 4 associated with a current amplifier 30. Blades 31 are provided with electrodes situated on their main faces. Contact pieces 14 connected to electric wires 15 and 16 are inserted between blocks 101 or 102 and the main face of blades 31. The contact pieces 14 comprise, on the blade side, an electricity conducting element and, on the block 101 and 102 side, an insulating element. This assembly ensures that the electrodes situated on the same side of blades 31 are parallel.

Figure 6:
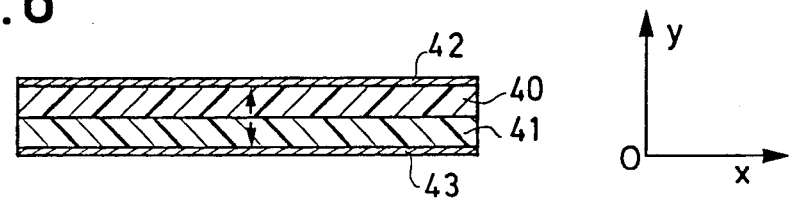
FIG. 6 shows the section of a dimorphous sensitive element.

FIG. 6 shows the sectional view of a dimorphous piezoelectric element formed of two piezoelectric material layers 40 and 41 having opposite polarizations. These permanent electric polarizations are parallel to the direction OY. Thus flexure of this dimorphous structure causes opposite electric charges to appear on the external faces of layers 40 and 41. The main external faces of layers 40 and 41 are coated with metal layers 42 and 43 forming electrodes. As shown in FIG. 5, one of the electrodes is connected by 15 to a terminal of the current amplifier 30, the other electrode being connected by 16 to the other terminal which is for example grounded. The piezoelectric material of layers 40 and 41 may more especially be a ceramic, for example PZT, a polymer, for example $PVF_2$ or a thin layer of Zn O deposited on a substrate. In the case of a piezoelectric ceramic, the total thickness is for example, 0.2 mm.

With layers 40 and 41 made from $PVF_2$, electrodes 42 and 43 may be formed by depositing, by vacuum evaporation, a layer of chromium of a thickness of 5 nm, a layer of aluminium of a thickness of 50 nm and a layer of chromium of a thickness of 5 nm. So as to avoid leakage currents from the external fluid medium, it is advantageous to coat electrodes 42 and 43 with an insulating film, for example a varnish.

Figure 7:
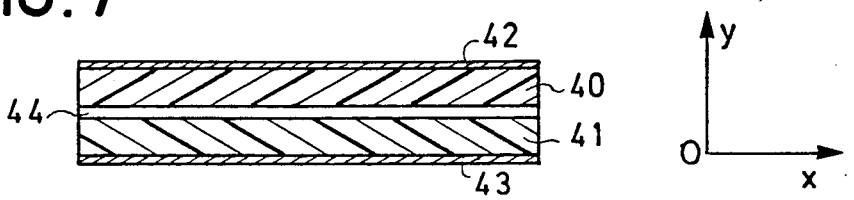
FIG. 7 shows the section of a three layer sensitive element.

FIG. 7 shows the sectional view of a three layer sensitive element. This element comprises two piezoelectric layers 40 and 41 with polarization parallel to direction Oy. Between layers 40 and 41 is disposed a layer 44. If layer 44 is chosen to be electrically conducting, the polarizations of layers 40 and 41 may be in the same direction, and for example layer 44 is grounded and the external electrodes are connected to the same output terminal. If, on the other hand, layer 44 is insulating, the polarizations of layers 40 and 41 are necessarily opposite. Layer 44 may for example be made from the same basic material as layers 40 and 41. One particular blade construction comprises two piezoelectric layers of $PVF_2$ 40 and 41 and a layer 44 of $PVF_2$ charged with carbon so as to be electrically conducting. In other constructions, layer 44 is a non polarized insulating layer.

Another variation of the invention comprises blades 31 formed from a single piezoelectric layer having an nonhomogeneous piezoelectric polarization in the direction of axis Oy.

Figure 8:
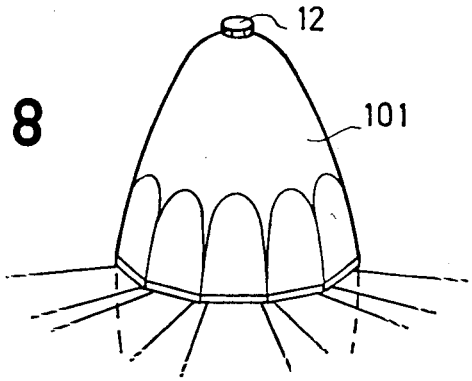
FIG. 8 shows an hydrodynamically profiled inertial mass.

FIG. 8 illustrates an ogival hydrodynamic profile of block 101 so that it is subjected as little as possible to the drive resulting from the particular movement of the fluid in which the hydrophone is plunged.

Figure 9:
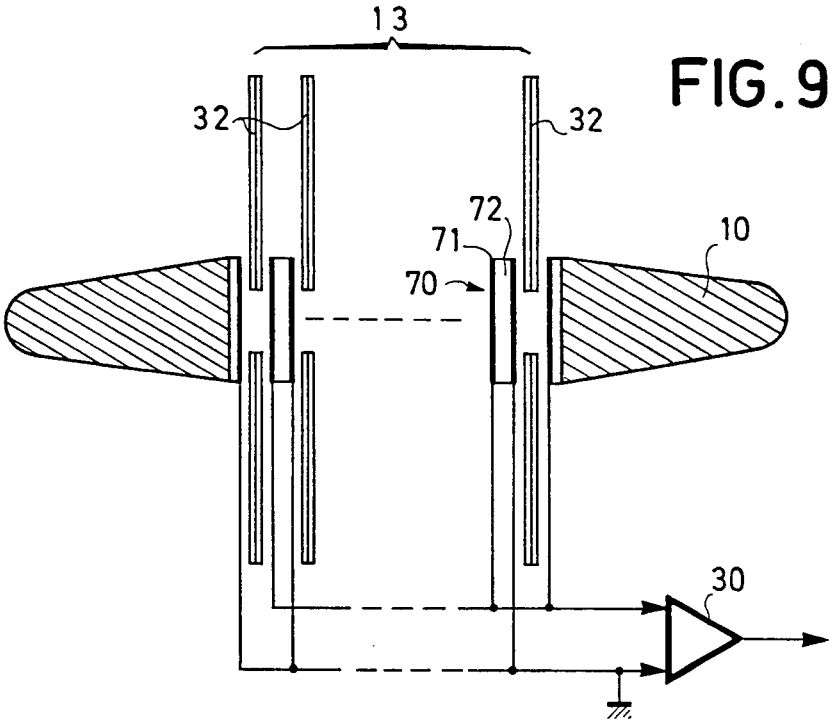
FIG. 9 shows a modification of the invention.

FIG. 9 shows a modification to FIG. 3. The speed hydrophone comprises a stepped assembly of sensors 32 whose blades are arranged in rings. Advantageously, blades 31 have an outwardly tapering shape towards the periphery.

Blades 31 have their electrodes placed in parallel by means of contact pieces 70. These latter blades comprise two conducting faces 71 separated by an insulating layer 72. A contact piece 72 is disposed between two ring sensors 32. The distribution of the ring sensors 32 increases the sensitivity to the incident acoustic waves.

The invention provides for fitting inertia blocks, for example made from a light alloy, to the peripheral end of blades 31. Advantageously, the assembly of these inertia blocks may form a binding ring mounted so that it does not act as a stiffener.

Figure 10:
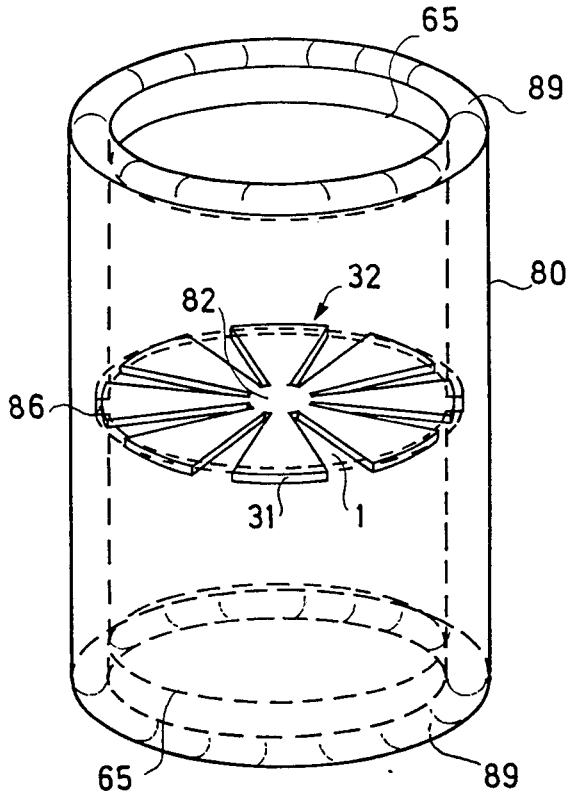
FIG. 10 shows a second embodiment of the invention.

FIG. 10 shows one construction comprising an inertial mass forming a cylindrical duct 80. The piezoelectric acoustic transducer comprises a single ring 32 of blades 31. The blades are separated from each other by radial slits 1. Ring 32 is embedded in the cylindrical duct 80 by a nipping groove 86. The driving edges 89 of the cylindrical duct 80 are hydrodynamically profiled.

In a variant, the cylindrical duct 80 is closed by impermeable membranes 65. Thus, inside the cylindrical duct 80 is a closed space which can be filled with an electrically insulating liquid providing good acoustic impedance matching. The membranes 65 transmit the vibratory movement of the water to the insulating liquid.

Figure 11:
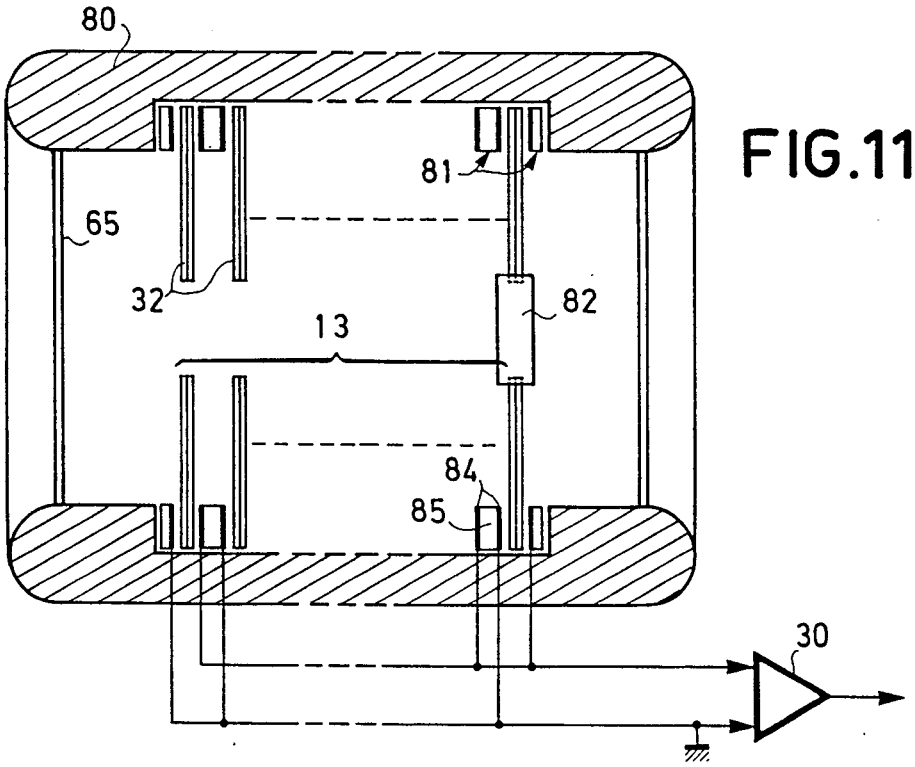
FIG. 11 shows another modification of the hydrophone of the invention.

FIG. 11 is a meridian section of a hydrophone comprising an inertial mass forming a cylindrical duct 80. Rings 32 of blades 31 are embedded by their periphery on the inside of the cylindrical duct 80. The electrodes carried by the faces of blades 31 are connected in parallel to the two inputs of a current amplifier through contactors 81. These latter comprise two conducting layers 84 separated by a ring of insulating material 85. A contactor 81 is provided between two successive rings 32 of blades 31.

In a variant, the cylindrical duct 80 is closed by impermeable membrane 65. Thus, inside the cylindrical duct 80 is formed a closed space which may be filled with an electrically insulating liquid for transmitting the acoustic waves. For example, with blades made from $PVF_2$, the cylindrical duct 80 may be filled with oil having high insulating power.

Figure 12:
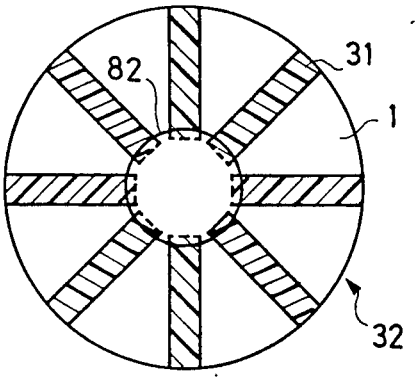
FIG. 12 shows a profile view relating to FIG. 11.
Figure 13:
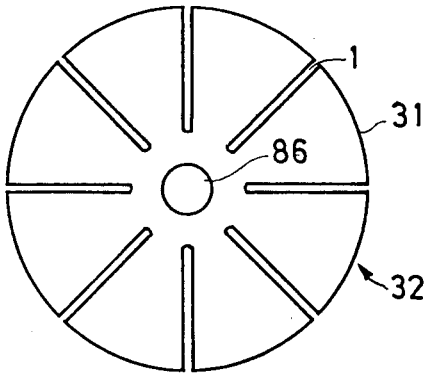
FIG. 13 is a profile view relating to FIG. 11.

FIGS. 12 and 13 give two embodiments of rings of blades 31. FIG. 12 illustrates one embodiment using a ceramic advantageously as piezoelectric material. The separate blades 31 are disposed radially and attached to the center by a connecting piece made from a light material 82. They are separated from each other by triangular spaces 1. FIG. 13 shows one embodiment using advantageously $PVF_2$ as piezoelectric material. Ring 32 illustrated in FIG. 13 may be used more especially with the hydrophones illustrated in FIGS. 3, 4, 5, 9, 10 and 11. Ring 32 is obtained by making cut-outs 1 in a disk made for example from $PVF_2$. The cut-outs 1 separate ring 32 into blades 31. For embedding the ring 32, a hole 86 is formed allowing fitting thereof into the devices illustrated in FIGS. 3, 4 5 and 9.

Rings 32 or the blades may be cut out from a disk of piezoelectric polymer, for example $PVF_2$, obtained by forging. How to obtain such a disk is described in the French patent application filed by the applicant on the 22nd February 1982 under the national registration No. 82.02 876. In such disks, the mechanical and piezoelectric anisotropy is invariant along concentric circles.

Figure 14:
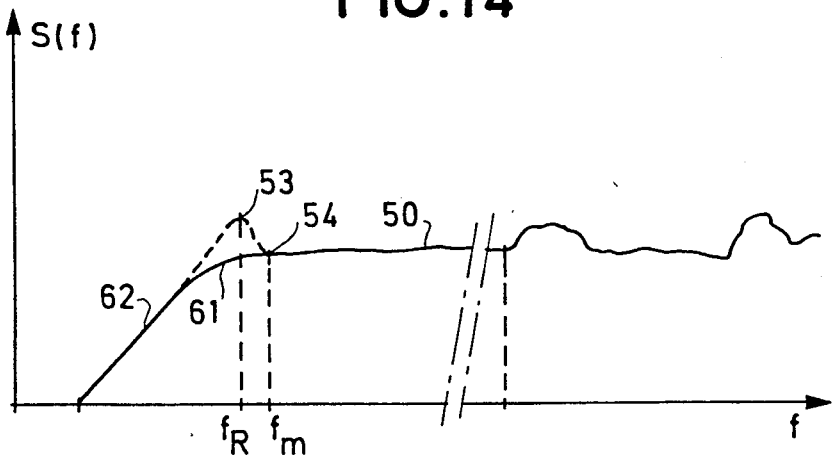
FIG. 14 is an explanatory diagram.

The diagram of FIG. 14 shows the trend of a velocity frequency response curve of a speed hydrophone. The diagram shows in abscissa the frequency f and as ordinates the amplitude of the electric signal S(f) supplied by the hydrophone in response to an incident acoustic wave of a predetermined level and frequency f. The curve comprises a plateau 50 which starts at the resonance frequency $f_R$ and which extends towards the high frequencies, except for the usual irregularities.

The range of constant sensitivity 50 is limited towards the low frequency end by a resonance range 54. At the resonance frequency $f_R$, the sensitivity may present a peak 53 or a rounded portion 61 depending on the damping provided. On this side of range 54, the response drops according to a slope of 12 dB/octave. The frequency response characteristic of FIG. 14 was obtained by connecting the hydrophone to an amplifier having a low electric impedance at all frequencies with respect to the internal impedance of the hydrophone. At high frequencies, this charge condition of the velocity hydrophone is not satisfied since the capacitive reactance decreases with the frequency, but other phenomena come into play to limit the constant level operating range towards the top.

Figure 15:
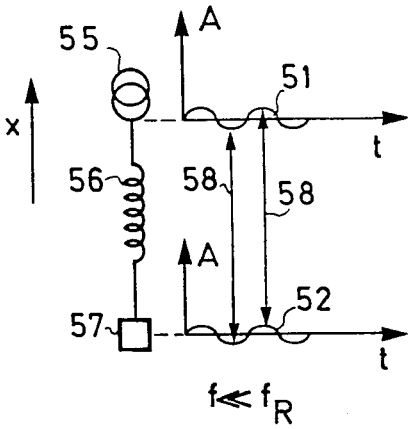
FIG. 15 is an explanatory Figure.
Figure 16:
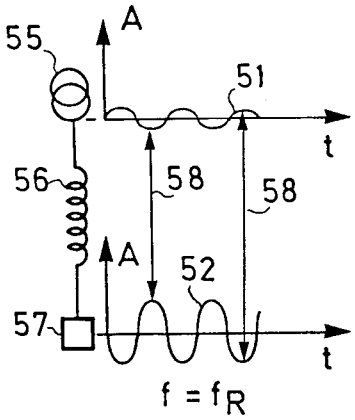
FIG. 16 is an explanatory Figure.
Figure 17:
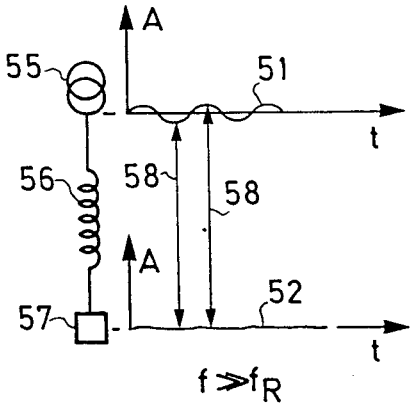
FIG. 17 is an explanatory Figure.

FIGS. 15, 16 and 17, are explanatory Figures for understanding the frequency behavior of the velocity hydrophone of the invention.

In the three cases of FIGS. 15, 16 and 17, the model used comprises mechanical energization by the acoustic wave symbolized by a particular velocity generator 55. The piezoelectric blades deformable under flexion are symbolized by a spring 56 which connects generator 55 to the inertial mass 57. The oscillogram 51 shows, with respect to time, the particular movement communicated to spring 56 and to the suspended mass 57. It is assumed that the incident acoustic wave has no direct drive action to the suspended mass 57. The passive spring-mass assembly forms then a resonating cell haaving a natural frequency $f_R$ depending on the ratio $\sqrt{k/m}$, where k represents the stiffness of the spring and m the mass serving for embedding the blades 31.

FIG. 16 corresponds to the case where the energization frequency corresponds to the resonance frequency $f_R$. The movements of mass 57 are in phase opposition with those of the connecting point between generator 55 and spring 56. The deformation 58 of spring 56 may have the magnitude greater than the amplitude of the energization.

FIG. 17 corresponds to the case where the energization frequency f is substantially greater than the resonance frequency $f_R$. The inertial mass 57 remains substantially motionless so that the movements communicated by generator 55 are applied substantially completely to the deformation 58 of spring 56. This operating mode corresponds to the sensitivity plateau 50 of FIG. 14.

Figure 18:
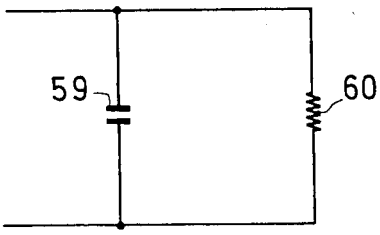
FIG. 18 is an explanatory diagram.

FIG. 18 is a simplified electric diagram of the connection between the speed hydrophone and its amplifier. Capacitor 59 of capacity C represents the internal admittance of the hydrophone. The admittance 60 of value Y represents the input circuit of the amplifier. According to this diagram, operation as velocityhydrophone is provided if the current i generated by piezoelectric effect passes as much as possible through the circuit of the amplifier, which presupposes that the admittance j C is less than Y. The input magnitude of the amplifier is practically the short circuit current of the piezoelectric generator.

We claim:

1. A velocity hydrophone immersible in a fluid for transforming acousting signals, transmitted along a given direction through the fluid, into electrical signals, the hydrophone comprising:

an elongated rod forming an inertial mass and having a longitudinal axis disposed parallel to said given direction;

a plurality of radially oriented spoke-shaped piezoelectric flexible blades cantilevered at their central ends to the rod, the blades respectively laying in planes oriented perpendicularly to said longitudinal axis;

the outward ends of the blades being generally restricted to follow acoustic signals transmitted through the fluid along a direction parallel to the longitudinal axis.

2. A hydrophone set forth in claim 1 wherein the piezoelectric blades include electrode members contacting piezoelectric elements; and further wherein the electrodes are connected to a current amplifier having a low electrical impedance with respect to the capacitive reactance of the blades so that substantially all of the current generated by the blades passes through the amplifier.

3. A hydrophone as claimed in claim 2, wherein said blades are formed from a material comprising at least two piezoelectric layers.

* * * * *